United States Patent [19]

Joshi et al.

[11] Patent Number: 4,490,280

[45] Date of Patent: Dec. 25, 1984

[54] PROCESS FOR MANUFACTURING TRANSLUCENT ANTIBACTERIAL SOAP

[75] Inventors: David P. Joshi, Plainfield, N.J.; Peter A. Divone, Woodhaven, N.Y.

[73] Assignee: Colgate-Palmolive Company, New York, N.Y.

[21] Appl. No.: 414,445

[22] Filed: Sep. 2, 1982

[51] Int. Cl.[3] ..... C11D 9/50; C11D 13/20; C11D 7/26

[52] U.S. Cl. ..... 252/368; 252/107; 252/108; 252/117; 252/118; 252/122; 252/132; 252/134; 252/369; 252/370; 252/DIG. 5; 252/DIG. 16

[58] Field of Search ..... 252/107, 108, 117, 118, 252/122, 132, 134, DIG. 16, DIG. 5, 368, 369, 370

[56] References Cited

U.S. PATENT DOCUMENTS

| | | | |
|---|---|---|---|
| 3,155,624 | 9/1964 | Kelly | 252/132 |
| 3,926,828 | 12/1975 | O'Neill et al. | 252/134 |
| 3,969,259 | 7/1976 | Lages | 252/108 |

FOREIGN PATENT DOCUMENTS

| | | | |
|---|---|---|---|
| 49-28645 | 7/1974 | Japan | 252/134 |

OTHER PUBLICATIONS

McCutcheon's Detergents and Emulsifiers, 1980 North American Edition, MC Publishing Co., N.J., U.S.A., p. 171.

*Primary Examiner*—John E. Kittle
*Assistant Examiner*—Mukund J. Shah
*Attorney, Agent, or Firm*—Herbert S. Sylvester; Murray M. Grill; John A. Stemwedel

[57] ABSTRACT

A translucent antibacterial soap is made by a process which includes dissolving a normally solid antibacterial material which is resistant to heat and alkali, e.g., 2,4,4'-trichloro-2'-hydroxy diphenyl ether (THDE), in a mixture of components for making such translucent antibacterial soap, which components include soaps of higher fatty acids in liquid form, such as with water in kettle soap, and converting said mixture to transparent soap cakes, preferably by a process which includes partially drying the mixture, working it and extruding it to bar form, which bar may be cut to length and pressed into the final desired translucent antibacterial soap cakes.

Preferably, the antibacterial compound, in powder form, is dissolved in a superfatting agent, such as mixed tallow fatty acids and coconut oil fatty acids and/or lanolin fatty acids, and then admixed at elevated temperature with the soaps of higher fatty acids that are a major constituent of the soap cakes to be made. In some instances it may be desirable to at least partially neutralize the fatty acids in which the antibacterial material may be dissolved and such neutralization can be effected prior to or after admixing of the mixture of fatty acids and antibacterial compound with the main body of the soaps of higher fatty acids.

The invention may be employed to make transparent soaps, colored transparent soaps, pearlescent-translucent soaps, translucent combination soap-synthetic and pearlescent-translucent combination soap-synthetic detergent tablets, and other soap and/or synthetic detergent products containing translucent and/or transparent components and compatible antibacterial materials.

11 Claims, No Drawings

PROCESS FOR MANUFACTURING TRANSLUCENT ANTIBACTERIAL SOAP

This invention relates to a process for the manufacture of translucent soaps. More particularly, it relates to making transparent soaps which contain a normally solid antibacterial material which tends to make the soap opaque unless incorporated therein by a special method, such as the process of this invention.

Translucent and transparent soap cakes and tablets have been moderately successfully marketed in relatively limited amounts for many years. Comparatively recently it has been discovered that milled and plodded translucent soaps can be made by various processes. However, when attempts have been made to incorporate antibacterial materials in translucent soaps, which materials, when normally solid, have usually been added to soap chips with other adjuvants in a soap amalgamator, the soap cakes produced are not translucent. One solution to this problem has been described in U.S. Pat. No. 3,969,259 wherein it was taught that a normally solid, essentially water insoluble antibacterial agent, 2,4,4'-trichloro-2'-hydroxy diphenyl ether, hereafter referred to as THDE, could be dissolved in perfume and then could be mixed with other constituents of a translucent soap in a soap amalgamator, prior to working, plodding and processing. Although such process results in an antibacterial translucent soap it does have significant disadvantages too. For example, the perfume, which often includes a wide variety of compounds, may be adversely affected by dissolving therein of the germicide, whereas it would not be so affected by contact with the germicide when it was substantially homogeneously distributed throughout the soap. Also, a separate dissolving operation is required, with additional equipment. On the contrary, the present invention allows the use of equipment already being employed to make the translucent soap product and the antibacterial material is dissolved in the soap (in liquid state) so that it is diluted and does not cause any unacceptable modifications of perfume notes.

In accordance with the present invention a process for manufacturing a translucent antibacterial soap comprises dissolving 2,4,4'-trichloro-2'-hydroxydiphenyl ether (THDE) in a mixture which includes soap of higher fatty acids and other components of a translucent soap, and converting said mixture to translucent soap cakes. Preferably, THDE is dissolved in a kettle soap, preferably a coco-tallow soap, at elevated temperature, and more preferably it is first dissolved in a superfatting component of the final soap, which is subsequently admixed with the soap and suitable adjuvants in a mixer, such as a soap crutcher, after which the mix is partially dried, worked, extruded as a bar and pressed into cake form. In a broader aspect of the invention, instead of THDE other bactericidal compounds of similar characteristics, which are normally solid, heat- and alkali-stable, and soluble in kettle soap or equivalent soap-water mixes may be employed, and they will also produce translucent bars and cakes. Among such germicides are other halogenated, hydroxy diphenyl ethers, which will be listed later, but other stable germicides may also be used. In other aspects of the invention, translucent soap-synthetic organic detergent cakes are produced of antibacterial properties, using lanolin soap and/or lanolin fatty acids to promote translucency.

The soaps that are utilized in making the products of this invention are what are normally referred to in the art as higher fatty acid soaps. Such may be made by the saponification of animal fats, greases and oils, and vegetable oils and fats, or may be made by the neutralization of fatty acids, which fatty acids may be derived from such animal and/or vegetable sources or may be synthesized. The fatty acids will normally be of essentially linear structure, with minor exceptions, and will be of about 8 to 22 carbon atoms, preferably 10 or 12 to 18 carbon atoms, in the monobasic fatty acid chain.

Excluding the lanolin soaps, which may be employed as anti-crystallization agents to promote translucency, the soaps (base soaps) that are utilized in making the products of this invention are what are normally referred to in the art as higher fatty acid soaps. Such may be made by the saponification of animal fats, greases and oils, and vegetable oils and fats, or may be made by the neutralization of fatty acids, which fatty acids may be derived from such animal and/or vegetable sources or may be synthesized. The fatty acids will normally be of essentially linear structure, with minor exceptions, and will be of about 8 to 22 carbon atoms, preferably 10 or 12 to 18 carbon atoms in the monobasic fatty acid chain.

Preferred soaps are those obtained by saponification of a mixture of tallow (and/or hydrogenated tallow) and coconut oil (and/or hydrogenated coconut oil) or neutralization of the corresponding fatty acids, with the proportions of such being from about 40 to 90% of tallow and about 60 to 10% of coconut oil. The mixed soap resulting is one in which the tallow and coconut oil-derived soaps are present in about the same proportions as given for the starting tallow and oil. Preferably such proportions will be from 50 to 85% of tallow (and tallow soap) and 50 to 15% of coconut oil (and coconut oil soap), and more preferably such ratios will be 70 to 80% of tallow and 30 to 20% of coconut oil, e.g., 75% of tallow and 25% of coconut oil (and the corresponding soaps). Similar proportions apply when the corresponding fatty acids are used.

In the soap art it is recognized that hydrogenation of the soap precursor triglycerides and corresponding fatty acids helps to improve stability of the soap because of the removal of reactive double bonds. However, when making a translucent or transparent soap it can be desirable to have some unsaturation in the soap, which sometimes helps inhibit crystallization, which promotes opacity. Therefore, complete hydrogenation of the soap oils and fats is sometimes contraindicated. On the other hand sometimes soaps made from more saturated fatty acids are more transparent, in which case hydrogenated raw materials can be preferred. Thus, although stability of the end product against oxidation, decomposition, reaction with other soap composition components and development of rancidity may not be as good when unhydrogenated fatty materials are employed for the manufacture of the soap, sometimes it may be desirable to "trade off" such improvements in product characteristics for a variety of reasons, in which case hydrogenated materials may be omitted. When hydrogenated fats, oils and fatty acids (and soaps) are present, usually they will constitute only minor proportions of the soap materials, such as 5 to 40% or 15 to 25%.

Although mixtures of tallow and coconut oil or of the corresponding fatty acids (or stripped or specially cut fatty acids) are considered to be the most desirable materials for the production of soaps used to make the products of this invention, other sources of such lipophilic moieties may also be employed. For example, the tallow utilized may be from animals other than cattle, such as sheep, and mixed tallows and greases can be employed. The oil may be palm oil, palm kernel oil, babassu oil, soybean oil, cottonseed oil, rapeseed oil or other comparable vegetable product, and whale or fish oils and lards and various other animal fats and oils may be employed to produce soaps substantially like those from the coconut oil and tallow mentioned. In some cases, the oils will be hydrogenated or otherwise processed to modify their characteristics so as to make them more acceptable as soap sources. The fatty acids obtainable from such fats and oils may be substituted as sources of superfatting components and as reactants from which the soaps are made. In some cases synthetic fatty acids may also be employed, such as those made by the Fischer-Tropsch hydrogenation of carbon monoxide, or by oxidation of petroleum.

The glycerides or fatty acids may be converted to soaps in a soap kettle or in other suitable neutralizing means, including thin film reactors, pipeline reactors and pump-type reactors, and mixed charges of fatty acids and glycerides may be used. Also, the soaps can be made, at least to a limited extent, in a mixing apparatus in which the other components of the transparent soap cake are blended together, usually at an elevated temperature, and prior to partial drying. The saponifying or neutralizing means will preferably be an alkali metal hydroxide or lower alkanolamine, although mixtures of such materials may also be employed in suitable circumstances. Of the alkali metal hydroxides sodium hydroxide is preferred but sometimes potassium hydroxide will be utilized, at least in part, because potassium soaps sometimes help to improve the transparency of the final soap cake. In appropriate circumstances other alkali metal compounds, of which the basic salts, e.g., sodium carbonate, potassium carbonate, can be most preferable, may be employed, as for the neutralization of free fatty acids. The lower alkanolamine will normally be one which has 2 or 3 carbon atoms per alkanol and 1 to 3 alkanols per molecule. Thus, among such compounds there are included, for example, triethanolamine, diisopropanolamine, isopropanolamine, di-n-propanolamine and triisopropanolamine. While the lower alkanolamines of 2 or 3 carbon atoms per alkanol are preferred, there may also be employed corresponding compounds wherein the alkanols are of 4 or 5 carbon atoms, but because soaps made from such bases may not be as useful in the present transparent products (and sometimes they may tend to have undesirable odors and other negative characteristics), if present at all they will usually constitute only relatively small proportions of the total soaps, e.g., 2 to 20%.

Translucent and transparent soap cakes and tablets made from higher fatty acid soaps may be either relatively high moisture content molded soaps, made by pouring molten soap into suitable molds, or may be harder soaps, such as those of lower moisture content, which may be worked, as by milling and plodding, before stamping to shape. The translucent products may be made by incorporating clarifying agents (or soap crystallization inhibitors), such as lower alkanols, but these are volatile and may evaporate off, resulting in opaque products. Milled and plodded translucent soaps can be made by various methods, including carefully regulating electrolyte content, utilizing resin soaps, employing some potassium soap, controlling moisture content and incorporating specified proportions of trans-oleic acid, hydrogenated castor oil soap, polyalkylene glycols, sugars, tetrakis (hydroxyalkyl) ethylene diamine, or specific organic and inorganic salts in the soap. Also, careful control of the working of particular formulations and energy added to them during processing was in some cases said to be useful in making plodded translucent soap tablets.

While the present invention may be utilized to make translucent soaps of a wide variety of formulations, incorporating any or several of many different and anticrystallization materials and/or made by any of various processes, it is highly preferred to employ lanolin fatty acids, lanolin soap, lanolin derivatives) or lanolin (cut or uncut), to promote translucency.

The lanolin soap and the lanolin fatty acids preferably utilized in the practice of this invention are complex materials which have been described at length in the art. The carbon contents of such fatty acids range from about 11 (or slightly less) through 35 (or a little higher), with the lowest molecular weight acids being the most odorous and smelling "woolly" (so that the higher molecular weight acids are the most preferred for aesthetic reasons). Different cuts of lanolin fatty acids may be employed but it is usually preferable to use the uncut material, although sometimes more of a component acid or a related material may be added to improve transparency. For example, it may be preferred to add lower alkanolamine isostearate and/or lower alkylamine isostearate. The various lanolin fatty acids and the soaps made are or are of normal, iso- and anteiso- fatty acids and in some cases they are alpha-hydroxy-substituted. Some sterols may be present with the fatty acids but are not considered to be a part thereof. The fatty acids constitute about half of lanolin, with sterols, e.g., lanosterols and cholesterol, being esterifying moieties. Lanolin fatty acids and soaps which are made from them are transparency aiding components of soap cakes and also can be admixed with soap in an amalgamator and worked to clarity, as by milling and plodding. While employment of lanolin fatty acids or soaps made from them is highly preferred, nevertheless it is also within a broader aspect of the present invention to use lanolin, lanolin fractions and lanolin derivatives, such as alkoxylated lanolin, for example, Solulan®98, Polychols, Satexlans, as superfatting ingredients and also as transparency aiding materials when they are mixed at elevated temperature with the tallow-coco soap and the suitable antibacterial material after which the mix is partly dired and processed to soap cakes. Of course it is also preferred to blend the lanolin soap and/or lanolin acids with other soaps and antibacterial material in the crutcher or soap kettle or other soapmaking equipment.

The lanolin soap may be made by reaction of the lanolin fatty acids with a base which is a lower alkanolamine, an alkali metal hydroxide, ammonium hydroxide or a lower alkylamine. The lower alkanolamine and alkali metal hydroxide (or basic alkali metal salt, which may be substituted for the alkali metal hyroxide) are the same as those previously described for saponification and/or neutralization of the tallow-coco triglycerides and/or fatty acids and the lower alkylamine is of 2 to 3 carbon atoms in the alkyl and of 1 to 3 alkyl groups per molecule. While neutralization may be effected in a soap kettle concurrently with the production of the tallow-coco soap (the suitable antibacterial material may also be present), and often such processing results in distinct product advantages (more translucent product of better odor because of steam distillation off of the lower molecular weight and more malodorous fractions) it will often preferably (for convenience) be conducted in a separate reaction vessel, such as a crutcher or blender located immediately prior to the dryer for the mix. Also, neutralization of any added fatty acid, such as isostearic acid, will preferably be effected in the crutcher or similar blender, although such can also take place in the soap kettle or other saponification equipment.

The only other required component of all the products of this invention, except for the antibacterial material, which will be discussed presently, is water, although it may often be highly desirable to utilize additional crystallization inhibiting materials in addition to the preferred lanolin soap, lanolin acids or other lanolin derivative or component. The water will normally be that present in a kettle soap or other soap resulting from other manufacturing processes, such as neutralization of soap making fatty acids, but in some instances it can be added. Also, when combination bars or tablets containing synthetic organic detergent and soap are made, part of the water may be that present in a synthetic detergent slurry or solution that is employed. If water is to be added it will be preferred that it be deionized water or other water of low hardness, preferably less than 150 parts per million, as calcium carbonate, and more preferably less than 50 p.p.m. In some instances the moisture content of a kettle soap or a crutcher mix may be lowered, as to 25% to 28% for the kettle soap and a corresponding lowered range for the crutcher mix, and the mix may be dried to a lower moisture content, e.g., 11 to 15%, to improve transfer ease (decrease any stickiness). Then, the moisture content may be increased about 1 to 5% by adding water to the amalgamator, and about 1 to 2% may be lost in working (mostly in milling), to produce a cake of desired moisture content (12 to 22%, preferably 16 to 18%), which is acceptably translucent.

The most preferred of the supplementing crystallization inhibitors which are preferably present in the products of this invention, and which, in combination with the lanolin material, help to produce translucent and even transparent cake products, are the polyols. Such materials, which contain 2 or more hydroxyl groups per mol, are preferably of 3 to 6 carbon atoms and 2 to 6 hydroxyl groups per mol. While sorbitol and glycerol are preferred polyols of this group other sugar alcohols, such as maltitol and mannitol, and sugars, such as glucose and fructose, may also be employed. Although technically sucrose is outside the description of the preferred polyols, it may be used as a supplementing anti-crystallization additive, preferably with one or more of the preferred polyols. Additionally, propylene glycol, various polyethylene glycols, hydrogenated castor oil, resins, and other materials known to have the desirable anti-crystallization activity may be employed. Hydrogenated castor oil, used in making some translucent soaps, is often avoided because of its objectionable odor and irritating nature but it is operative to make translucent antibacterial soaps, as are ethanol, EDTA, etc. While the use of volatile materials to promote transluency is not to be excluded from the present compositions it is a distinct advantage of this invention that such materials are not required and preferably are not employed.

Although isostearic acid is a constituent of lanolin and therefore is present in the lanolin soap (or the isostearic acid is present in the lanolin fatty acid) it has been noted in the application of one of the present inventors (Joshi) entitled Translucent Soaps and Processes for Manufacture Thereof, filed the same day as the present application that good translucency of the soap tablets is still obtainable when additional lower alkanolamine isostearate is present in the composition, to which it may be added to improve handling of the lanolin soap. The lower alkanolamine is of the type previously described and the isostearate may be made by neutralization of isostearic acid by the alkanolamine, using conventional methods. It may be pure or it may include some other analogous and homologous soaps, too. Preferably the isostearate soap is more than 80% isostearate, such as isopropanolamine isostearate or triethanolamine isostearate, or a mixture thereof.

If combination soap-synthetic organic detergent bars or cakes are to be made, the synthetic organic detergent will preferably be an anionic detergent, although nonionic detergents and amphoteric detergents may also be employed, and such different types of detergents may be employed alone or in mixture. Preferably the anionic detergents will be water soluble sulfates or sulfonates having lipophilic moieties which include straight chain or substantially straight chain alkyl groups having 10 to 20 carbon atoms, preferably 12 to 18 carbon atoms. The sulf(on)ates may include as the cation thereof sodium, potassium, lower alkylamine, lower alkanolamine, ammonium or other suitable solubilizing metal or radical. Among the preferred anionic detergents are the paraffin sulfonates, olefin sulfonates, monoglyceride sulfates, higher fatty alcohol sulfates, higher fatty alcohol polyethoxy sulfates, sulfosuccinates and sarcosides, e.g., sodium paraffin sulfonate wherein the paraffin is of 14 to 16 carbon atoms, sodium coconut oil monoglyceride sulfate, sodium lauryl sulfate, sodium triethoxy lauryl sulfate, and potassium N-lauroyl sarcoside. The nonionic detergents will be normally solid (at room temperature) compounds, such as condensation products of higher fatty alcohols of 10 to 20 carbon atoms with ethylene oxide wherein the molar ratio of ethylene oxide to fatty alcohol is from 6 to 20, preferably 12 to 16, polyethylene glycol esters corresponding to such ethers, and block copolymers of ethylene oxide and propylene oxide, (Pluronics®). The amphoteric materials that may be employed include the aminopropionates, iminodipropionates and imidazolinium betaines, of which Deriphat®151, a sodium N-coco-beta aminopropionate (manufactured by General Mills, Inc.), is an example. Other such anionic, nonionic and amphoteric detergents are described in McCutcheon's *Detergents and Emulsifiers,* 1973 Annual, and in *Surface Active Agents,* Vol. II, by Schwartz, Perry and Berch (Interscience Publishers, 1958).

Various other adjuvant materials may be present in the soap cakes of this invention, providing that they do not objectionably interfere with the translucency or transparency of the desired product. Usually, such adjuvants will be present in relatively small proportions, such as up to no more than 2, 3, or 5% (total), and 1 or 2% (individual). Among such are perfumes, dyes, pigments (usually for an opaque portion of a variegated or striated soap), optical brighteners, additional superfatting agents, antioxidants and foam enhancers, e.g., lauric myristic diethanolamide. Generally, inorganic salts and fillers will be avoided to the extent possible but small quantities of these may sometimes be present. However, finely divided mica and other suitable pearlescing agents (including crushed shells and suitable shiny minerals) of desired size may be mixed with the other soap components or parts thereof to give the final tablet an opalescent or plearlescent appearance which is especially attractive because the transparent or translucent soap allows viewing of the mica particles whereas these are obscured by opaque soaps. The preferred mica particles are less than No. 100, preferably less than No. 200 and more preferably less than No. 325, U.S. Sieve Series, and will often be about 2 to 10 microns, average equivalent spherical diameter. A suitable such product is a muscovite mica sold under the name Mearlmica MMMA by The Mearl Corporation, New York, N.Y. The mica or other such agent is preferably dispersed in a liquid, e.g., glycerol, at a 5 to 20% concentration, and is added in the amalgamator to make a product containing 0.05 to 0.5% mica. It may also be added to one soap only, used to make a variegated or striated final soap cake.

The perfume employed will normally include a transparent essential oil and an intensifying agent, and often will also incorporate a synthetic odorant or extender. These materials are well known in the art and need not be recited at length herein, except for the giving of illustrative examples. Thus, among the essential oils and compounds found in such oils that are useful may be mentioned geraniol, citronellol, ylang-ylang and sandalwood.

The antibacterial material utilized in accordance with the present invention is one which is sufficiently stable and soluble at the elevated temperature employed and in the medium in which it is dissolved so that it retains a substantial proportion, preferably essentially all, of its antibacterial activity and won't adversely affect the light transmission properties of an otherwise translucent or transparent product. While various suitable bactericides and bacteriostats may be employed, most of them will be of the halogenated hydroxy aromatic types, preferably polyhalogenated hydroxy diphenyl ethers. The preferred halogen is usually chlorine, although bromine and fluorine substitution may also be feasible. Preferably the number of halogens will be from 2 to 5, more preferably 3 or 4, and the number of hydroxyls will be from 1 to 3, preferably 1 or 2 and more preferably 1. The halogens and hydroxyl(s) are preferably located ortho or para to the etheric oxygen of the diphenyl ethers.

The most preferred of the antibacterial materials is 2,4,4'-trichloro-2'-hydroxy diphenyl ether, sold under the trademark Irgasan ®CH3565 by CIBA Geigy Corporation and described in *Soap and Chemical Specialties,* January 1968, in an article beginning at page 47. This material decomposes at a temperature in the range of 280° to 290° C. so it is stable at the temperatures at which kettle soap and crutcher mixes are kept (which normally will be no higher than about 140° C., even under pressure). The melting point of Irgasan CH3565 (also known as DP-300) is in the range of about 54° to 57° C. so it may be more readily dissolved in kettle soaps and crutcher mixes if they are raised above such a temperature (although lower temperatures may be useful when the THDE is only dissolved, rather than melted). THDE is stable in toilet soaps stored for a year at 50° C. and is stable in such soaps for at least two years at room temperature. Also, it does not decompose below 280° C. while being refluxed for 15 hours in a 20% aqueous sodium hydroxide solution. While 2,4,4'-trichloro-2'-hydroxy diphenyl ether is the preferred bactericide utilized in the present invention, the corresponding fluorinated and/or brominated analogues and mixed chlorobromo-fluoro analogues may also be employed, as may be similar compounds wherein the 2' hydroxy and 4' chlorine are interchanged. Similarly, such compounds wherein the 4 chloro is moved to the 6 position, and the corresponding bromo- and fluoro-analogues may be employed.

The stability of the antibacterial compound in soap and at elevated temperatures is important for continued antibacterial activity of the soap but it is also important to prevent the translucent soap cake from becoming opaque or cloudy in appearance. In this respect, the bactericide, which is normally a white powder, must be sufficiently soluble so as not to interfere with the translucency of the soap cake (or soap-synthetic organic detergent cake) made. The antibacterial material is considered to be dissolved in the soap matrix and in such state it does not interfere with the anti-crystallization activity of the "translucifying" agent(s) present. However, whether or not the THDE or other bactericide actually dissolves is not of vital importance providing that the particles or other forms thereof are sufficiently small and well dispersed and/or clear so as not to interfere with the translucency of the product. Thus, when in this specification the word "dissolved" is used it is to be considered as also having such broader meaning.

Although THDE is a very effective antibacterial material it is recognized that other phenol-based germicides have also been effective in soaps and more of them are sufficiently soluble as to be employable in translucent soaps. However, among the best of such materials, the halocarbanilides, such as trichlorocarbanilide and halosalicylanilide, such as tetrachlorosalicylanilide and tribromosalicylanilide, may both decompose to yield very hazardous haloanilines, such as chloranilines and bromanilines. Even with only a small percentage of decomposition, the production of haloanilines effectively mitigates against employing such materials in high temperature media, such as kettle soap and heated crutcher mixes, and therein lies another advantage of the THDE type of bacteriostat.

The proportions of the various components of the translucent antibacterial soap cakes of this invention will be chosen to promote such translucency or transparency and effective antibacterial action and often the proportions will be such as to give the resulting soap cake other desirable characteristics too, such as sheen or gloss, hardness, lathering power, low sloughing, and desired solubility and cleaning characteristics. Generally, the soap cake will comprise from 45 to 95% of soap (excluding lanolin soap and any added isostearate soap), 1 to 15% of translucifying agent, preferably lanolin soap or lanolin fatty acids or a mixture of such lanolin soap(s) and lanolin fatty acids, 0.05 to 5 parts of antibacterial agent and about 5 to 25% of water. The percentages of lanolin soap (and/or lanolin fatty acids) and water will both be chosen to promote translucency. When a polyol of the type described for further promoting translucency is also present, as it is in preferred products, the proportion of soap (mixed tallow and coconut oil soaps) will be from 45 to 90%, preferably 60 to 84% and more preferably 68 to 79%, e.g., about 76%, the lanolin soap and/or lanolin fatty acids or other translucifying agent) will be from about 1 to 15%, preferably 1 to 10%, more preferably 2 to 8%, or 2 to 4%, e.g., about 3%, the polyol will be about 2 to 12%, preferably 4 to 10%, more preferably 5 to 7%, e.g., about 6%, the THDE content will be 0.05 to 5%, preferably 0.1 to 1% and more preferably 0.15 to 0.7%, e.g., 0.5%, and the water content will be about 5 to 25%, preferably 9 to 20%, more preferably 14 to 18%, e.g., about 15 or 16%. In such soap cakes the tallow-coconut oil soap will usually contain from about 40 to 90% of tallow soap and 60 to 10% of coconut oil soap, preferably 50 to 85% of tallow soap and 50 to 15% of coconut oil soap, and more preferably 70 to 80% of tallow soap and 30 to 20% of coconut oil soap, e.g., about 75% of tallow soap and about 25% of coconut oil soap. Of course, as was previously mentioned, equivalents of such soaps may be substituted so long as the final product is of approximately the same end composition. When lanolin fatty acids are present they act as superfatting agents, giving the soap cake very desirable skin softening properties, in addition to promoting transparency, and improving lathering. When such superfatting is present it will be 0.1 to 5 or 10%, preferably 0.5 to 3 or 5%, e.g., usually 2 or 3% of the soap cake.

When added lower alkanolamine isostearate soap is present in the translucent tablet, generally only so much will be employed as will significantly improve processing. Thus, from 0.5 to 4%, preferably 1 to 3% and more preferably about 2% will often be present. If anti-crystallization additives other than those for which proportions have already been mentioned are present they will usually not exceed 5% of the tablet and normally the total proportion of anticrystallization compounds, including lanolin soap, lanolin fatty acids, polyol, sugars, hydrogenated castor oil and others, will not exceed 25%, preferably being no more than 20% and more preferably being no more than about 15% of the product.

When variegated tablets are made, including at least some translucent soap, they will generally comprise from 1 to 20 parts of such translucent soap and 20 to 1 parts of a contrasting translucent soap (preferably of the same type) or an opaque soap or a mixture of such translucent soap and opaque soap. Thus, tablets can be made which are mostly translucent to mostly opaque. In variegated products the proportions of the mentioned parts are preferably 1 to 5 to 5 to 1 and more preferably are 1 to 3 to 3 to 1. The different component soaps of the variegated soaps will preferably be of the same formulas, insofar as is possible, so that the only difference between them will be in one being translucent or transparent and the other being differently colored (if also translucent or transparent) and/or opaque. Thus, it is considered desirable for the lanolin soap or lanolin fatty acids to be present in the opaque composition as well as in the translucent compositions. It is considered that if significant differences in formulations between components soaps of the variegated soaps exist the soaps may not cohere satisfactorily during manufacture and use. It is clear that variegated soaps of this invention may include transparent soaps of different colors, transparent and translucent soaps of the same or different colors, transparent and opaque of the same or different colors, translucent and opaque soaps of the same or different colors, and transparent, translucent and opaque soaps of the same or different colors. Additionally some of the mentioned soap parts may be made pearlescent, as previously described. Thus, many combinations of aesthetic effects are producible. The variegated and straited products referred to above are disclosed herein but are not claimed because they are presently considered to be the inventions of one of the present inventors and another, and are expected to be the subjects of another patent application.

As used in this specification, and particularly in the above paragraph, the meanings of "transparent" and "translucent" are those generally employed and are in accordance with usual dictionary definitions. Thus, a transparent soap is one that, like glass, allows the ready viewing of objects behind it. A translucent soap is one which allows light to pass through it but the light may be so scattered, as by a very small proportion of crystals or insolubles that it will not be possible to clearly identify objects behind the translucent soap. Of course, even "transparent" objects, such as glass, can prevent seeing through them if they are thick enough. For the purpose of this specification, it will be considered that the soap section tested for transparency or translucency is approximately 6.4 mm. thick ($\frac{1}{4}$ inch). Thus, if one is able to read 14 point bold face type through a $\frac{1}{4}$ inch or 6.4 mm. thickness of soap, the soap qualifies as transparent. If one can see light through such thickness but can't read the type the soap is only translucent. Of course, all transparent soaps also qualify as translucent (considering translucent as generic). Other tests for transparency and translucency, including the translucency voltage test mentioned in U.S. Pat. No. 2,970,116, may also be employed.

However, the best test is one invented by a present inventor in which a translucent bar can be tested for translucency easily, reproducibly and without any need to cut a soap cake to a lesser thickness. All that is needed is a light source, such as a flashlight, and a photographic light meter. The flashlight is turned on, the soap cake, without modification, is placed against the light and the light meter is placed against the other face of the cake. A meter reading directly measures translucency. Clearly, comparative readings against a control allow calibration of any meter and light. The equipment is readily available, inexpensive, easy to use, readily portable, and familiar to all. The readings are reproducible and accurate. It is considered that this test, named the Colgate-Joshi Translucency Test, may well become the standard in this field in the near future.

Combination soap-synthetic organic detergent cakes which are translucent may be made when about 40 to 90% of soap is mixed with 5 to 55% of normally solid synthetic organic detergent of the type(s) previously mentioned. Preferably, such ratios will be 70 to 90% of soap and 10 to 25% of synthetic organic detergent. The percentages given are on a final bar basis, which accounts for the fact that they do not add up to 100%. Of the synthetic compounds, the paraffin sulfonates, higher alcohol sulfates and monoglyceride sulfates are preferred. Variegated soap-synthetic detergent cakes may be made in the same general manner as previously described for variegated soaps.

The various described antibacterial tablets, whether translucent or transparent, pearlescent, superfatted or not, variegated, all soap or with both soap and synthetic detergent in the compositon, may be made using various types of apparatuses and processing steps but preferred processes all include blending the soap (and synthetic organic detergent, if a combination bar is to be made), lanolin soap (or lanolin fatty acids, lanolin or suitable derivative thereof) and water (usually present with the soap and/or synthetic organic detergent) at an elevated temperature, with antibacterial agent dissolved therein and partially drying such mixture. As previously mentioned, the lanolin soap may be made with the base soap in a soap kettle or other saponifier, and the antibacterial agent may be dissolved in the kettle soap or crutcher mix, preferably by being dissolved in fatty acids or lanolin fatty acids being charged to the kettle or crutcher. If the bactericide is charged to the kettle with oils and fats preferably it will be done near the end of the saponification so that little THDE (or other antibacterial) will be lost with the steam from the kettle or in the lye or nigre. The dried mix may be compounded with perfume, colorant, water and other minor adjuvants which do not significantly adversely affect the transparency or translucency of the product, worked, as by milling on a five-roll soap mill, plodded, and pressed to shape. In preferred embodiments of the invention polyol anti-crystallization compound may be mixed with the soap, antibacterial compound, lanolin soap and water, optionally with supplementary property enhancing agents, such as diethanolamine isostearate, and the entire mix may be dried. Also, some saponification of animal and vegetable derived fatty acids and of lanolin and isostearic acid may take place in a crutcher or other mixer, usually when lanolin or lanolin fatty acids are being saponified or neutralized, or when amine or alkanolamine neutralization of free fatty acid is being effected. Of course, an excess of lanolin or other saponifiable or neutralizable lipophile may be employed so that part of it remains as superfatting agent in the soap cake.

The various materials being employed are commercially available for the most part, although it is usually highly desirable, almost a practical necessity, for means for manufacturing large quantities of the main soap base to be on premises. Thus, for example, the germicide may be obtained from CIBA-Geigy Corp., as previously mentioned. Lanolin fatty acids, preferably the entire fatty acid cut from lanolin, except possibly for the lowest and highest fatty acids, may be purchased from Amerchol Corporation, Croda Corporation or Emergy Industries, Inc., as may be various derivatives of lanolin, and such may be converted to soaps, as described, and by equivalent methods. Isostearic acid is also commercially available, as are the various polyols mentioned. The mixed animal fat and vegetable oil soaps may be made by the full boiled kettle process or by any of various other processes that have been successfully employed for the manufacture of soaps. For example, continuous neutralization of fatty acids, continuous saponification of fat-oil mixtures, sonic saponification methods, enzyme processes, multi-stage saponifications and neutralizations, and in-line and pump saponifications and neutralizations may be employed, so long as they produce a satisfactory end product. In some instances, the end product will contain glycerol from the saponification of glycerides (usually triglycerides) and such may be left in the soap to act as a crystallization inhibitor, in conjunction with the lanolin soap, lanolin fatty acids, etc.

In the broadest aspect of the present process translucent antibacterial soap cakes are made by mixing together, at an elevated temperature a stable soluble germicide and soap, together with other components of a translucent soap, and sufficient water, usually with the soap, usually from 20 to 45%, preferably 25 to 40%, to maintain the soap and mix desirably fluid, after which the mixture is partially dried to a moisture content in the range of 5 to 25%, at which moisture content a subsequently worked, extruded and pressed cake of such composition will be translucent, and the mix is worked, extruded and pressed into finished translucent soap cakes, usually after cutting of the extruded bar into blanks for pressing.

The mixing may take place at a temperature in the range of 40° to 160° C. but in preferred aspects of the process the temperature is in the range of 65° to 95° C., more preferably 70° to 90° C. and most preferably 80° to 90° C. The drying occurs at a temperature in the range of 40° to 160° C., preferably 40° to 60° C., such as 45° to 50° C., for an open belt or tunnel dryer, in which the mix is converted to ribbon form on a chill roll and is subsequently dried in a hot air dryer, with higher temperatures, usually from 70° C. to 160° C., often being used for various other types of dryers, including atmospheric plate heat exchangers (APV), thin film evaporators (Turbafilm evaporators) which operate at room temperature, and superheat and flash evaporators, such as the Mazzoni evaporators, which operate under vacuum. Of course, other types of dryers may also be used so long as they do not cause objectionable crystallization and resulting opacity of the mix or so long as they do not cause such crystallization which is not reversible in further processing. Usually it has been noted that rapid drying favors translucency of the product, as opposed to opacity which can more readily result when drying is slower, which condition favors crystallization.

Normally, before drying, various components of the mix to be dried are blended together, as previously suggested, and during such blending, as when a crutcher or other suitable mixer is employed, lanolin fatty acids may be converted to lanolin soap to the extent desired, or other such neutralization or saponification reactions may be undertaken. Such mixing may be in a portion of equipment intended primarily for drying, as in an upstream in-line piper mixer, such as one of the Kenics or equivalent type. However, it is preferred, for more readily and accurately controllable operations, to utilize a soap crutcher, from which the mix is pumped to the dryer. While crutchers normally operate batchwise, two or more of them may be used alternately to maintain a continuous feed to the dryer. Preferably, the drying operation will be continuous so that a steady feed of chips will be available for processing into bars and cakes. Still, it is within the invention to temporarily store such chips in bins before use. Due to their content of bactericide bacterial decomposition of the moist soap chips during storage is inhibited. Amalgamators or other suitable mixers, in which the chips are combined with perfume and other additives which do not adversely affect translucency, are normally used in batch operations but continuous blending is also within the invention.

In the process for manufacturing the translucent soap cakes the mix to be dried will usually contain about 45 to 95 parts of soap of a type previously described, about 0.05 to 5 parts of THDE or similarly effective antibacterial material, about 1 to 10 parts of lanolin soap, lanolin fatty acids or other lanolin material, about 2 to 12 parts of polyol and about 25 to 50 parts of water, and the drying will be done to a moisture content in the range of 5 to 25%. Of course other minor components may also be present in the mix but they will rarely exceed 15 or 20 parts. Preferred proportions of the components are 60 to 84 parts of soap, 0.1 to 1 part of THDE, 2 to 8 parts of lanolin soap or other lanolin material, 4 to 10 parts of polyol, preferably sorbitol, glycerol and/or maltitol, and 30 to 45 parts of water, and drying will be to a moisture content in the range of 12 to 22%. In more preferable processes 68 to 70 parts of soap, 0.15 to 0.7 part of THDE, 2 to 4 parts of lanolin soap, 5 to 7 parts of sorbitol and 30 to 45 parts of water will be present in the mix and the drying will be to a final moisture content such that the moisture in the soap cakes is from 14 to 18 or 20%, (with the moisture content of the chip being about 0 or 1 to 3% more). Drying times vary, usually being from as little as few seconds to as much as an hour, with typical drying times for flash processes being from 1 to 10 seconds and for belt drying being from 2 to 20 minutes. As mentioned previously shorter drying times are usually preferable.

After the completion of drying to the desired moisture content at which the dried material is translucent or capable of being converted to translucent form with a reasonable amount of working, the partially dried chip is mixed with perfume and any other desired adjuvants which will not objectionably opacify the mix. Such mixing preferably takes place in a conventional soap amalgamator, such as one equipped with a sigma-shaped blade, but various other types of mixers and blenders may also be employed. Among the other adjuvants that may be blended in the amalgamator with the partially dried soap (or soap-synthetic detergent chip, when combination bars are to be produced), are fluorescent brighteners, colorants, stabilizers, antioxidants, and pearlescing materials.

After amalgamating or equivalent mixing or blending, the perfumed mix may then be plodded or otherwise compacted, as by extrusion, to bar form and may subsequently be converted to a cake or tablet by cutting and/or pressing. While plodding without preliminary milling is feasible and can produce a transparent soap, it is normally preferable for the amalgamated mixture to be milled or equivalently worked before plodding. Such working may be such as to raise the temperature of the milled material to or maintain it at a desired level for optimum translucency. It has been found that such temperature will often be in the range of about 30° to 52° C. preferably 35° to 45° C., e.g., 39° to 43° C., but the ranges can differ for different soaps and different soap-synthetic detergent mixtures. Normally it will be desirable for both milling and plodding (and other working) temperatures to be held within such ranges. During milling the chip thickness will normally be kept within the range of 0.1 mm. to 0.8 mm., preferably being from 0.1 mm. to 0.4 mm., with the smaller ribbon thicknesses being those removed from the mill. Although a three-roll mill may be employed it is highly preferred to use one or two five-roll mills (with roll clearances being adjustable). If desired, the chip may be put through the mill twice or more, or a plurality of mills may be utilized, with the discharge from one being the feed to another.

From the mill or other working device, if employed, the chip is fed to a vacuum plodder or equivalent extruder, preferably a dual barrel plodder capable of producing high extrusion pressures. The plodder is equipped with a cooling jacket to hold the temperature of the soap within the working ranges previously recited. Air, which enters the plodder with the chip feed, is removed in a vacuum chamber and the bar extruded is clear in appearance. The compacted and additionally worked plodder material is extruded as a plodder bar, which is automatically cut to lengths and pressed to shape by appropriate dies. The transparent or translucent soap cakes made are then automatically wrapped, cased and sent to storage, prior to distribution. Any waste from the pressing operation may be replodded with other feed to the plodder but such recycling is best effected when variegated or opalescent products are being made (in which cases no irregularities due to the different feeds are discernible). However, because THDE is heat-stable soap scrap containing it may be fed back to the crutcher and/or soap kettle.

When variegated soaps or other mixed color or mixed character soaps (or soap-detergent cakes) are to be produced, two different charges of soap of different colors or other identifiable characteristics are fed to the vacuum plodder in desired proportions, or a colorant is added to the plodder with the soap charge so that the color thereof will be unevenly distributed throughout the soap. A Trafilino variegator may be employed to feed the different soap cylinders, and/or a glycerol suspension of mica powder and dye may be dripped into the bottom barrel of the plodder or the plodder head to make an opalescently variegated or striated soap. The variegated plodder bar resulting may be pressed to different patterns, as desired, depending on which face thereof is most desirably distorted by the pressing operation.

The following examples illustrate the invention but do not limit it. Unless otherwise indicated all parts are by weight and all temperatures are in °C.

| Components | Percent |
|---|---|
| Sodium coco-tallow soap (25:75 coco:tallow) | 74.2 |
| Triethanolamine soap of lanolin fatty acids | 4.0 |
| Sorbitol | 6.0 |
| Moisture | 15.0 |
| Bactericide (2,4,4'-trichloro-2'-hydroxy diphenyl ether) | 0.3 |
| Perfume (pine type) | 0.5 |
| | 100.0 |

A translucent soap bar of the above formula is made by dissolving the bactericide in lanolin fatty acids (from which the lanolin soap is made) after which the lanolin fatty acids are neutralized with a stoichiometric proportion of triethanolamine and the soap resulting is mixed with the kettle soap and sorbitol in a soap crutcher. The kettle soap and the crutcher mix are at a temperature of about 70° C. and the kettle soap moisture content is about 28.5%. Because the triethanolamine and lanolin fatty acids are reacted in approximately stoichiometric proportions no excess of triethanolamine is present in the crutcher mix and little if any free lanolin fatty acids remain therein. After mixing for approximately five minutes after addition of all the components the crutcher mix is pumped to a continuous Mazzoni flash dryer, wherein the mix, at a temperature of about 70° C. (higher temperatures may also be used), is flashed into a vaccum chamber so that the moisture content thereof is reduced to about 17%. The dried mix is removed from the Mazzoni apparatus and is blended with the formula proportion of perfume, after which the amalgamated mixture is milled, using a five-roll soap mill with roll clearances diminishing from 0.4 to 0.2 mm. The mill temperature is regulated so that the soap ribbons produced are at a temperature of about 42° C. The mill ribbons, which appear somewhat translucent, are then plodded in a dual barrel vacuum plodder, with the soap temperature being held at about 42° C., and are extruded as a continuous bar, which is cut to blank lengths, stamped to final form, wrapped, cased, and sent to storage.

The soap cakes made are transparent, so that 14-point type can be read through a 6 mm. thickness thereof. They are of satisfactory lathering and foaming properties, are good cleansers, are of attractive appearance, with good sheen or gloss, are hard, do not crack during use, and maintain their transparency during use. Tests of the effectiveness of the THDE bactericide show that it is effective and was not inactivated by the manufacturing process. The soap cakes made maintain their transparency during storage, and in fact, appear to become even more transparent after storage for about a month.

That the aged soap cakes are as transparent as or more transparent than those initially made and are as transparent as or more transparent than acceptably transparent commercial products of this general type is readily established by use of the Colgate-Joshi translucency test, which has been described in more detail in the co-pending application of David P. Joshi, previously mentioned.

In the above formula the coco-tallow soap can be changed to include hydrogenated coconut oil soap and hydrogenated tallow soap, both to the extent of about ¼ of the amounts of such soaps present, the lanolin fatty acid soap can be made by neutralization with isopropanolamine, the sorbitol may be replaced by glycerol, maltitol and/or mannitol, in various mixtures, e.g., 2:2:2, the perfume may be changed and the bactericide may be replaced with an equivalent polychloro hydroxy phenyl ether or a bromine analogue and the result will still be a satisfactory translucent soap cake of the desired properties previously mentioned in this example. Further changes in the formulation include modifying the ratios of the coconut oil and tallow to 50:50, 40:60 and 20:80 and in all such cases satisfactory products are obtainable, although those higher in coconut oil soap content may be less translucent. Even when such soaps are completely hydrogenated useful antibacterial and translucent products can be made, although processing conditions control may be more critical to avoid processing difficulties and undesirable end product characteristics. When the proportions of the various components are changed to ±10%, ±20% and ±25%, while maintaining them within the ranges disclosed in the preceding specification, useful antibacterial and translucent soap cakes are also made.

The processing described may also be modified so that the neutralization of the lanolin fatty acids with triethanolamine takes place in a preliminary reactor, from which the lanolin soap is pumped to the soap crutcher, or initial mixing may be in the crutcher. The bactericide may be dissolved in a superfatting quantity, such as 1 to 10%, preferably 2 to 5%, of lanolin fatty acids or other superfatting acids, such as a superfatting mixture of coconut oil fatty acids and tallow fatty acids or of lauric acid and stearic acid, and such fatty acids will be free in the product made, although some additional fatty acids may be converted to soaps. Temperatures and moisture contents may be changed within the ranges given in the specification and instead of drying the crutcher mix in a flash dryer, a tunnel dryer may be employed at a lower temperature, e.g., one in the range of 40° to 50° C. The products resulting will also be satisfactory translucent or transparent antibacterial soaps.

EXAMPLE 2

| | Percent |
|---|---|
| Sodium coco-tallow kettle soap (30% water content, 17:83 coco:tallow) | 79.1 |
| Tetrasodium ethylene diamine tetraacetate (30% aqueous solution) | 0.06 |
| Stannic chloride (50% aqueous solution) | 0.15 |
| Hydrogenated castor oil | 5.9 |
| Sodium hydroxide (38% $Na_2O$ aqueous solution) | 1.5 |
| Sodium chloride | 0.8 |
| Glycerine | 5.3 |
| Deionized water | 3.1 |
| Distilled coconut oil fatty acids ($C_{12-14}$ range) | 3.8 |
| Ditertiary butyl para-cresol | 0.04 |
| 2,4,4'-trichloro-2'-hydroxy diphenyl ether | 0.25 |
| | 100.0 |

The above crutcher formula is made by dissolving the THDE bactericide and ditertiary butyl para-cresol (an anti-oxidant) in the coco fatty acids at a temperature in the range of about 50° to 60° C. (above the melting point of the fatty acids). This preliminary mixture is then admixed with the previously mixed balance of the crutcher formula components (mixed at 75° C.) and mixing is continued for about 5 minutes, with the mixture being at a temperature in the range of about 65° to 95° C., preferably 70° to 90° C., after which the crutcher mix is dried by a Mazzoni flash dryer (but a tunnel dryer may be substituted) at such elevated temperature to a moisture content of about 17%. In an amalgamator a small proportion of color solution, which may be about 1% of a 5% aqueous dye solution, and about 1% of perfume are blended with the partially dried crutcher mix at about room temperature, after which the mix is passed five times through a three-roll mill to produce chips of a thickness of about 0.1 to 0.4 mm., which are then plodded in a dual barrel vacuum plodder to bar form, after which the bars are cut to blanks and pressed to final shape. The soap cakes resulting are superior in transparency to similar cakes in which the THDE is dissolved in the perfume solution, as suggested in U.S. Pat. No. 3,969,259, even when more perfume is used as a solvent. Of course, they are also far superior in translucency to soap cakes made by adding the THDE in finely divided powder form (through No. 325 sieve, U.S. Sieve Series) to the amalgamator, which product is opaque. Another benefit of incorporating the THDE in the crutcher mix (or in the kettle soap before it is added to the crutcher mix) is that loads on processing equipment, such as the plodder, are significantly reduced. Thus, with respect to the plodding operation it is noted that about 10% more electric power is required when THDE is added in the amalgamator in perfume solution instead of being added to the kettle soap or crutcher mix in accordance with the present invention.

This example illustrates the employment of hydrogenated castor oil soap as a translucifying agent but other such agents may be substituted for it, including sorbitol, glycerol, maltitol, mannitol, propylene glycol, ethanol (not preferred), lanolin fatty acids (preferred), lanolin soaps (also preferred), and lanolin and derivatives thereof, and results like those reported in this example will be obtained.

Instead of preliminarily dissolving the THDE in the fatty acids supperfatting agent, it may be dissolved in polyhydric alcohols, such as propylene glycol, in other fatty acids or lanolin fatty acids or in the hydrogenated castor oil (although when dissolved in the hydrogenated castor oil the temperature of the oil will be comparatively high, above 80° C. because of the relatively high melting point of hydrogenated castor oil). It may also be dissolved in mixtures of such "solvents". Alternatively, as previously mentioned, the THDE or other satisfactory antibacterial agent may be dissolved in the kettle soap (or in soap made by another making process).

EXAMPLE 3

| | Percent |
|---|---|
| Sodium coco-tallow soap (25:75 coco:tallow) | 72.5 |
| Lanolin fatty acids (uncut) | 3.0 |
| THDE | 0.5 |
| Sorbitol (added as 70% aqueous solution) | 6.0 |
| Stannic chloride (added as 50% aqueous solution) | 0.2 |
| Sodium ethylene diamine tetraacetate (added as 20% aqueous solution) | 0.10 |
| Dye (added as dilute aqueous solution) | 0.2 |
| Perfume | 1.5 |
| Moisture | 16.0 |
| | 100.0 |

A translucent soap bar of the above formula is made substantially in the manner described in Example 1. The lanolin fatty acids are used to melt and dissolve the THDE at a temperature of about 60° C. and the solution is then admixed with the 71.5% solids content kettle soap at the described elevated temperature, which may be as high as 80° C., after which the other components, except that perfume, are also admixed, and the crutcher mix is dried in a Mazzoni flash dryer or a tunner dryer, followed by amalgamation with perfume and any other temperature sensitive constituents of the formula (stannic chloride, sodium EDTA and colorant may be added in the amalgamator instead of the crutcher). The final translucent soap cakes made are of the satisfactory properties described for the product of Example 1 and it even appears that translucency has been improved, which is thought to be due to the replacement of the lanolin soap with lanolin fatty acids.

When the proportion of THDE present is changed to 0.18%, 0.5% and 1% a clear soap cake is also made. In some instances the proportion of lanolin fatty acids used to dissolve/melt the THDE is increased to promote solution, e.g., 8% lanolin acids for 1% THDE.

In other experiments the proportion of lanolin fatty acids is changed to 1%, 2%, 4% and 8%, while holding the THDE content at about 0.3%, and bar characteristics are noted. Improved translucency is observable when the lanolin content is increased from 1 to 3% but the 4% lanolin fatty acids formulation does not appear to be very noticeably clearer than the 3% formulation. Further doubling of the lanolin fatty acids content (in all such cases the other variable changed is the sodium coco-tallow soap content) does not have much effect on translucency, although it does improve the emollient action of the soap significantly.

When the 0.3% THDE and 3% lanolin fatty acids formula is modified by replacing 0.7% of the coco-tallow soap with finely divided mica so as to make a pearlescent product, with the mica particles showing through the translucent soap, at least near the surface of the cake, an improved antibacterial soap cake of distinctive and attractive pearlescent appearance results. The finely divided mica employed is that sold under the trademark MEARLMICA MMMA. It is a nearly white, water-ground muscovite mica of particle sizes under No. 325, U.S. Sieve Series, with most of the platelets thereof in the range of 2 to 40 microns in their longest dimension and being of about 6 to 10 microns average equivalent spherical diameter. Such mica powder has a bulk density of about 150 grams/liter and a surface area of about 3 square meters per gram.

Combination soap-synthetic organic detergent products of similar properties may be made by replacing about 15%, on a final bar basis, of the sodium coco-tallow soap with a suitable synthetic organic detergent, e.g., sodium triethoxylauryl sulfate, sodium N-lauroyl sarcoside, sodium hydrogenated coconut oil fatty acids monoglyceride sulfate, sodium lauryl sulfate, Pluronic F-68, Neodol 25-6.5 and/or Deriphat 151. Such replacement may be made in both the non-pearlescent and pearlescent formulas. If the products are not sufficiently translucent in particular formulas, additional anti-crystallization components may be employed, e.g., propylene glycol, or increased proportions of such components may be used, e.g., 5% of lanolin fatty acid and 8% of sorbitol or sorbitol-glycerol mixtures. The products, like those previously described, are satisfactory personal size and bath size antibacterial toilet soaps, possess excellent emollient characteristics, lather profusely and are attractive in appearance.

EXAMPLE 4

A kettle soap is made from a charge of lipophiles consisting of 21% of coconut oil, 75% of tallow and 4% of lanolin, with the soap being boiled with sufficient caustic solution (50% NaOH) and brine to completely saponify the oils mentioned, leaving a free alkali content of 0.1% (as $Na_2O$), 0.7% of sodium chloride and 2% of glycerine in the neat soap (on a solids basis). This kettle soap has THDE powder added to it while it is at a temperature of about 85° C. in such proportion as to constitute 0.33% of the kettle soap. Alternatively, the THDE may be dissolved in the soap in the kettle or in soapmaking oils and fats, although care will have to be taken that the THDE is not lost during the soapmaking process in the nigre and lye and by steam distillation. The kettle soap containing THDE is then utilized as a charge to a soap crutcher, with sufficient sorbitol being added so that the soap made from such mixture by partially drying it contains about 15% of moisture, 6% of sorbitol, 1.6% of glycerine, 0.5% of sodium chloride, 3% of lanolin soap, 0.3% of THDE and the balance, 73.6%, of a coco:tallow soap of about 22:78 coco:tallow ratio and some lanolin alcohols.

The soap cake made is satisfactorily translucent and is otherwise an excellent antibacterial toilet soap bar. It appears to be harder and slightly more translucent than comparable cakes made by the addition of lanolin, lanolin fatty acids or lanolin derivative and it has been theorized that such is due to the fact that the anti-crystallizing lanolin soap was present with the coco:tallow soap when it was being made and therefore could inhibit crystallization and the production of crystallization "seeds" at such stage, as well as during subsequent workings. When desired, additional lanolin soap and/or lanolin fatty acids, e.g., 3% of lanolin fatty acids, are added in the crutcher.

The soap made has less of a characteristic woolly or lanolin odor than a comparable product made by addition of all the lanolin soap in the crutcher. It is considered that at least in part this is due to the continuous steam distillation effected by the use of live steam for mixing the reactants in the soap kettle, which distillation removes some of the more volatile and more odorous lanolin constituents. Also, the presence of the THDE since the kettle soap stage may help to prevent bacterial degradation during storage before processing.

EXAMPLE 5

A crutcher mix is made of 70 parts of an anhydrous 37.5:62.5 coco:tallow sodium soap accompanied by a moisture content of about 28% of the kettle soap, 6 parts of sorbitol (added as a 70% aqueous solution), 0.75 part of propylene glycol, 0.75 part of THDE, 4 parts of triethanolamine soap of lanolin fatty acids and 1 part of triethanolamine isostearate. The triethanolamine soaps are made by pre-reacting 3 parts of lanolin fatty acids and 0.75 part of isostearic acid with 1.25 parts of triethanolamine, and the reaction product, which is completely saponified, is found to be of better handling characteristics in the translucent soap formula than is a similar product without the isostearate (without which the soap may be too hard). After mixing of the various components of the crutcher mix the mix is dried in a Proctor & Schwartz hot air, moving wire belt tunnel dryer, after being converted to ribbons on a chill roll. The dryer, which operates using hot air at a temperature of about 45° to 50° C., dries the chip to a moisture content of about 18%. Such chip is then mixed with about 1% of perfume (floral type) in an amalgamator, without the addition of water, and is made into a final toilet soap cake of good translucence by the method described in Example 1. The product is a good translucent soap, of as good transparency as commercial "transparent soaps", of excellent lathering power, low dry cracking tendencies, good emolliency, excellent antibacterial activity and stable transparency. It is an attractive product but its appearance and other properties can be further improved by addition of colorant, stabilizer, bactericide, etc., in the amalgamator, with perfume.

In variations of this experiment isopropanolamine and other lower alkanolamines are substituted for the triethanolamine and similarly useful translucent soap cakes are obtained. In other variations of the formula, the sodium soap may be at least partially, e.g., 10%, replaced with potassium soaps and/or with other lower alkanolamine or lower alkylamine soaps, such as diethanolamine soaps of the same fatty acid composition and triethylamine soaps. Similarly, the lanolin soaps made for addition to the kettle soaps or base soaps may be alkali metal hydroxide soaps, such as sodium or potassium soaps, or may be soaps of ammonium hydroxide, and useful translucent toilet soaps are obtained.

EXAMPLE 6

| | Percent |
|---|---|
| Sodium coco tallow soap (37.5:62.5 coco:tallow) | 71.3 |
| Lanolin fatty acids | 3 |
| Sorbitol | 4 |
| Glycerol | 2 |
| Moisture | 18 |
| Perfume | 1.5 |
| THDE | 0.2 |
| | 100.0 |

A translucent soap bar of the above formula is made by the method of Example 1. Its characteristics are those of products of the preceding examples. It is an acceptable and satisfactory translucent antibacterial soap of excellent emollient characteristics.

The above formula may be varied by including small percentages, from 0.1 to 1.5%, of fluorescent brightener, and similar proportions of suitable dyes, bactericides and antioxidants in the crutcher mix at the expense of the base soap, and a good translucent product is still obtained. Furthermore, when from 0.3 to 0.8% of pearlescent mica of the type previously described is also included in the crutcher (or amalgamator), preferably dispersed in the formula proportion of glycerine, an attractive pearlescent product is obtained. In another variation, in accordance with another invention previously referred to in this specification, when a Trafilino vacuum plodder mechanism is utilized a variegated product may be produced, which can be variegated and pearlescent or striated, too.

All the translucent soap cakes made in accordance with the preceding examples process easier due to incorporation of the THDE (and other stable antibacterial compounds) in the soap base, are of improved deodorant power and stability due to the bacteriostat being unformly distributed, are of more uniform transparency and translucency and appear to be of better perfume characteristics, possibly due to the germicide being in lesser localized contact with the perfume.

The invention has been described with respect to various illustrations and embodiments thereof but it is not to be considered as limited to these because it is evident that one of skill in the art with the present specification before him will be able to utilize substitutes and equivalents without departing from the invention.

What is claimed is:

1. A process for manufacturing a translucent antibacterial soap which comprises dissolving an antibacterial proportion of 2,4,4'-trichloro-2'-hydroxydiphenyl ether (THDE) in liquid lanolin fatty acids which function as superfatting and translucence promoting agents in the translucent antibacterial soap, mixing the dissolved THDE in the lanolin fatty acids with a normally solid higher fatty acid soap in liquid state, admixing with such mixture other components of a translucent soap, if any, and converting such mixture to translucent soap cakes.

2. A process according to claim 1 wherein the mixture includes mixed tallow and coconut oil soaps and water, and is at a temperature in the range of about 45° to 95° C.

3. A process according to claim 1 wherein the THDE is dissolved in liquid lanolin fatty acids at an elevated temperature and such THDE solution is then admixed with the soap.

4. A process according to claim 1 wherein the THDE is dissolved in liquid lanolin fatty acids and a portion of such fatty acids is neutralized to produce a corresponding lanolin soap, either before, concurrently with or after admixing with the higher fatty acid soap, leaving some of the lanolin fatty acids unneutralized to function as translucence promoting and superfatting agents.

5. A process according to claim 1 wherein the mixture comprises about 45 to 90 parts of mixed tallow and coconut oil soaps which are soaps of a base selected from the group consisting of lower alkanolamine and alkali metal hydroxide, and mixtures thereof, with from about 40 to 90% of the soap being tallow soap and about 60 to 10% of the soap being coconut oil soap, about 1 to 10 parts of liquid lanolin fatty acids which serve as an organic translucence promoting agent, about 2 to 12 parts of a polyol of 3 to 6 carbon atoms and 2 to 6 hydroxy groups, and about 20 to 40 parts of water, at a temperature of about 45° to 95° C. and has about 0.05 to 5 parts of THDE dissolved therein.

6. A process according to claim 6 wherein the THDE is dissolved in 2 to 10% of lanolin fatty acids which superfat the soap, which is a mixture of 50 to 85% of tallow soap and 50 to 15% of coconut oil soap.

7. A process according to claim 6 wherein the mixture is a crutcher mix, the crutcher mix is dried, perfume is added to the dried mix and the resulting mixture is milled, plodded, cut and stamped to cake form.

8. A process for manufacturing a translucent antibacterial soap which comprises dissolving a normally solid heat resistant and alkali resistant antibacterial material in liquid lanolin fatty acids, mixing said liquid lanolin fatty acids with dissolved antibacterial material therein in with a soap of higher fatty acids, water and other component(s) of a translucent soap, drying the resulting mixture to a moisture content at which it is translucent, and converting it to translucent cake form.

9. A process according to claim 8 wherein the mixture resulting from drying, which is that resulting from partial drying, is worked and extruded into bar form, from which cakes are pressed, and scrap from such bars, cakes and/or the pressing operation is recycled by mixing it with kettle soap and other components of the antibacterial translucent soap, after which the mixture resulting is dried to a moisture content at which it is translucent, and is converted to translucent cake form.

10. A process for manufacturing a translucent antibacterial soap which comprises (a) dissolving 0.05 to 5 parts of 2,4,4'-trichloro-2'-hydroxydiphenyl ether (THDE) in about 1 to 10 parts of liquid lanolin fatty acids which function as superfatting and translucence promoting agents, (b) admixing the dissolved THDE in a liquid sodium tallow-coco kettle soap mixture which comprises (i) about 45 to 90 parts of mixed tallow and coconut oil sodium soaps with from about 50 to 85% of the mixture being tallow soap and with from about 50 to 15% of the mixture being coconut oil soap, (ii) about 2 to 12 parts of a polyol of 3 to 6 carbon atoms and 2 to 6 hydroxy groups, and (iii) about 20 to 40 parts of water, the admixing being accomplished at a temperature of about 45° to 90° C., and (c) converting the mixture to translucent soap cakes.

11. The process according to claim 10 wherein at least a portion of the lanolin fatty acids is neutralized to produce a corresponding soap, either before, concurrently with or after admixing with the sodium tallow-coco kettle soap.

* * * * *